US007810427B2

(12) United States Patent
Ishino et al.

(10) Patent No.: US 7,810,427 B2
(45) **Date of Patent: *Oct. 12, 2010**

(54) CIRCULATION CONVEYOR FOR FOOD AND DRINK

(75) Inventors: Haruki Ishino, Kanazawa (JP); Yuichi Ishino, Kanazawa (JP); Shigeki Ishino, Kanazawa (JP)

(73) Assignee: Ishino Seisakusyo Co., Ltd., Kanazawa-shi, Ishikawa (JP)

( * ) Notice: Subject to any disclaimer, the term of this patent is extended or adjusted under 35 U.S.C. 154(b) by 369 days.

This patent is subject to a terminal disclaimer.

(21) Appl. No.: 11/667,571

(22) PCT Filed: Nov. 9, 2005

(86) PCT No.: PCT/JP2005/020531

§ 371 (c)(1),
(2), (4) Date: Sep. 19, 2007

(87) PCT Pub. No.: WO2006/054467

PCT Pub. Date: May 26, 2006

(65) Prior Publication Data

US 2008/0179169 A1 Jul. 31, 2008

(30) Foreign Application Priority Data

Nov. 16, 2004 (JP) ..... 2004-332058

(51) Int. Cl.
*A47G 23/08* (2006.01)

(52) U.S. Cl. ..... 99/483; 186/38; 186/49; 198/952

(58) Field of Classification Search ..... 99/352–355, 99/386, 443 C, 495, 443 R, 484, 646 R, 467–479, 99/275–333; 198/340–349, 358, 952; 186/38, 186/39, 49; 705/15; 126/41 C, 246; 219/400, 219/388

See application file for complete search history.

(56) References Cited

U.S. PATENT DOCUMENTS 3,856,135 A * 12/1974 Hayakawa et al. ..... 198/860.5

(Continued)

FOREIGN PATENT DOCUMENTS

JP 3-87474 9/1991

(Continued)

OTHER PUBLICATIONS

Machine translation of Japan Patent No. 2001-245,775, Mar. 2010.*

*Primary Examiner*—Geoffrey S Evans
(74) *Attorney, Agent, or Firm*—Chapman and Cutler LLP

(57) ABSTRACT

A circulation conveyor for foods and drinks effectively controls internal temperature of a tunnel section covering an upper portion of a circulation-type conveyor path for foods and drinks. The conveyor has a tunnel section covering an upper portion of and in the longitudinal direction of the carrying path. A cooling and heating pipe 24 inside the tunnel section in its longitudinal direction controls internal temperature of the tunnel section. In the tunnel section, upper and lower ventilation openings 32 and 33, disposed above and below, respectively, of the cooling and heating pipe 24 are provided. The ventilation openings communicate via communication pipes 30*a* to 30*c* to circulate air, and an air blowing section 34 circulates air in the tunnel section by drawing air from one of the upper or lower ventilation openings, into the pipes, and discharges the air from the other opening.

11 Claims, 5 Drawing Sheets

U.S. PATENT DOCUMENTS 4,349,086 A * 9/1982 Yamada ..... 186/49
4,401,189 A * 8/1983 Majewski ..... 186/68
5,123,178 A * 6/1992 Stein ..... 34/88
5,477,778 A * 12/1995 Kuwahara ..... 99/483
5,557,096 A * 9/1996 Watanabe et al. ..... 235/492
6,427,806 B1 * 8/2002 Tanaka ..... 186/49
6,431,318 B1 * 8/2002 Tanaka ..... 186/49
6,554,106 B1 * 4/2003 Tokimoto ..... 186/49
6,581,727 B1 * 6/2003 Tokuno ..... 186/50
7,243,758 B2 * 7/2007 Ishino et al. ..... 186/49
2002/0158058 A1 * 10/2002 Faries et al. ..... 219/400

FOREIGN PATENT DOCUMENTS

JP 2001-245775 9/2001
JP 2001-245775 A * 9/2001
JP 2001-333850 A * 12/2001
JP 2001-333851 A * 12/2001

* cited by examiner

CIRCULATION CONVEYOR FOR FOOD AND DRINK

TECHNICAL FIELD

The present invention relates to a circulation conveyor for foods and drinks on which a tunnel section capable of preventing foods and drinks being conveyed on a circulation type carrying path from drying out, or preventing foreign bodies from attaching to the foods and drinks is provided, and which can control an internal temperature of the tunnel section to provide customers with hot or cold foods and drinks.

RELATED ART

Conventionally, when foods and drinks such as Sushi are provided at a counter for serving foods and drinks to customers where containers such as plates with foods and drinks placed thereon are mounted and conveyed on an endlessly-formed circulation carrying path, there is the problem that the foods and drinks lose freshness or dry out during being conveyed to customers from a kitchen depending on a temperature or dryness in a restaurant.

Recently, not only Sushi but Yum cha, noodles or the like are provided at such counter for serving foods and drinks, and there is a demand that these foods and drinks remain hot until they are provided to customers.

To this end, such method has been proposed as the method of providing a tunnel section which covers an upper portion of a carrying path on which containers such as plates with foods and drinks placed thereon are mounted and conveyed, and controlling a temperature in the tunnel section by a cooling and heating pipe provided inside the tunnel section in its longitudinal direction, to thereby keep freshness of foods and drinks and provide customers with hot or cold foods and drinks (See Patent Document 1).

Patent Document 1:

Japanese Patent Application Laid-Open No. 2001-245775 (Page 2, FIG. 3)

DISCLOSURE OF THE INVENTION

Problems to be Solved by the Invention

However, in Patent Document 1, even if a surface temperature of the cooling and heating pipe is changed, cold air tends to be accumulated in a lower portion and hot air tends to be accumulated in an upper portion in the tunnel section, to generate a temperature difference between the upper portion and the lower portion of the tunnel section. Thus, there is the problem that it is difficult to obtain a suitable temperature in a portion adjacent to foods and drinks which are circulately conveyed in the lower portion of the tunnel section.

In order to solve such problems, an object of the present invention is to provide a circulation conveyor for foods and drinks capable of effectively controlling an internal temperature of a tunnel section which covers an upper portion of a circulation-type carrying path on which foods and drinks are circulately conveyed.

Means for Solving the Problems

In order to solve the problems as described above, according to a first aspect of the present invention, a circulation conveyor for foods and drinks includes a tunnel section formed covering an upper portion of and in the longitudinal direction of a circulation-type carrying path for conveying and supplying foods and drinks, and a cooling and heating pipe disposed inside the tunnel section in its longitudinal direction, a surface temperature of which is changed to control an internal temperature of the tunnel section, wherein, in the tunnel section, an upper ventilation opening disposed above the cooling and heating pipe and a lower ventilation opening disposed below the cooling and heating pipe are provided in the longitudinal direction of the carrying path, the upper ventilation opening and the lower ventilation opening are communicated with each other via a communication path so as to circulate air, and an air blowing section is provided for circulating air in the tunnel section by drawing air from one of the upper ventilation opening and the lower ventilation opening into the communication path and discharging the drawn air from the other ventilation opening.

In the above aspect, since the air blowing section draws the air in the tunnel section from one of the upper and lower ventilation openings and discharges the air from the other ventilation opening, the air in the tunnel section flows from the upper portion to the lower portion, or from the lower portion to the upper portion, and the air is circulated between the tunnel section and the communication path. Therefore, cold air or hot air of the cooling and heating pipe effectively spreads in the tunnel section without being accumulated in the upper or lower portions, and a temperature difference between the regions above and below the cooling and heating pipe become less generated. Also, since the air is circulated, the internal temperature of the tunnel section can be effectively controlled.

According to a second aspect of the present invention, the circulation conveyor for foods and drinks according to the first aspect is characterized in that the lower ventilation opening is disposed at both sides of the carrying path.

In the above aspect, because of the air flow in the vicinity of foods and drinks, cold air or hot air from the cooling and heating pipe spreads in the vicinity of foods and drinks, and therefore, it is possible to effectively bring a surrounding temperature of the foods and drinks close to a surface temperature of the cooling and heating pipe. Also, since the air supplied from or drawn into the lower ventilation openings does not directly touch the foods and drinks, it is possible to prevent the foods and drinks from drying out.

According to a third aspect of the present invention, the circulation conveyor for foods and drinks according to the first or second aspect is characterized in that a guiding wall for guiding foods and drinks, which move on the carrying path, toward the conveyance direction is disposed at a side of the carrying path, and the lower ventilation opening is formed in a surface of the guiding wall.

In the above aspect, the lower ventilation opening can be easily formed by using the guiding wall.

According to a fourth aspect of the present invention, the circulation conveyor for foods and drinks according to the first to third aspects is characterized in that the tunnel section includes a plurality of frame members disposed at predetermined positions of the carrying path, and covering members attached to the frame members, and one portion of the communication path is formed inside the frame member.

In the above aspect, the communication path is not exposed in the tunnel section and customers cannot see the communication path. Therefore, the appearance is improved.

According to a fifth aspect of the present invention, the circulation conveyor for foods and drinks according to the first to fourth aspects, further includes an upper temperature sensor for detecting a temperature of an upper region above the cooling and heating pipe in the tunnel section, a lower temperature sensor for detecting a temperature of a lower region below the cooling and heating pipe in the tunnel section, and an air blow controlling section for controlling air blow of the air blowing section based on temperatures respectively detected by the upper temperature sensor and the lower temperature sensor.

In the above aspect, it is possible to perform optimum air blow control corresponding to a temperature status since such air blow control can be performed that the air blow volume is changed in response to a temperature difference between the temperatures detected by the upper and lower temperature sensors.

According to a sixth aspect of the present invention, the circulation conveyor according to the fifth aspect is characterized in that the tunnel section is configured such that the air blowing section is independently disposed in each of a plurality of areas divided in the longitudinal direction of the carrying path so as to independently circulate air, and the air blow controlling section controls air blow of the air blowing section independently disposed in each of the plurality of areas, based on temperatures respectively detected by the upper temperature sensor and the lower temperature sensor, which are independently disposed in each of the plurality of areas.

In the above aspect, it is possible to separately circulate air in the tunnel section in each area, and the internal temperature of the tunnel section can be effectively partly controlled.

REFERENCE NUMERALS

1: Crescent Chain Conveyor
2: Conveyor Housing (Guiding Wall)
5: Tunnel Section
6: Ceiling Panel (Covering Member)
7: Open/Close Cover (Covering Member)
8: Frame Member
11: Open/Close Cover (Covering Member)
24: Cooling and Heating Pipe
26: Gutter Member
30*a* to 30*c*: Communication Pipe
31: Communication Path
32: Upper Ventilation Opening
33: Lower Ventilation Opening
34: Air Blower (Air Blowing Section)
36: Upper Temperature Sensor
37: Lower Temperature Sensor
38: Control Device (Air Blow Controlling Section)

BEST MODES FOR CARRYING OUT THE INVENTION

Embodiments of the present invention are described below.

Embodiment

Figure 1:
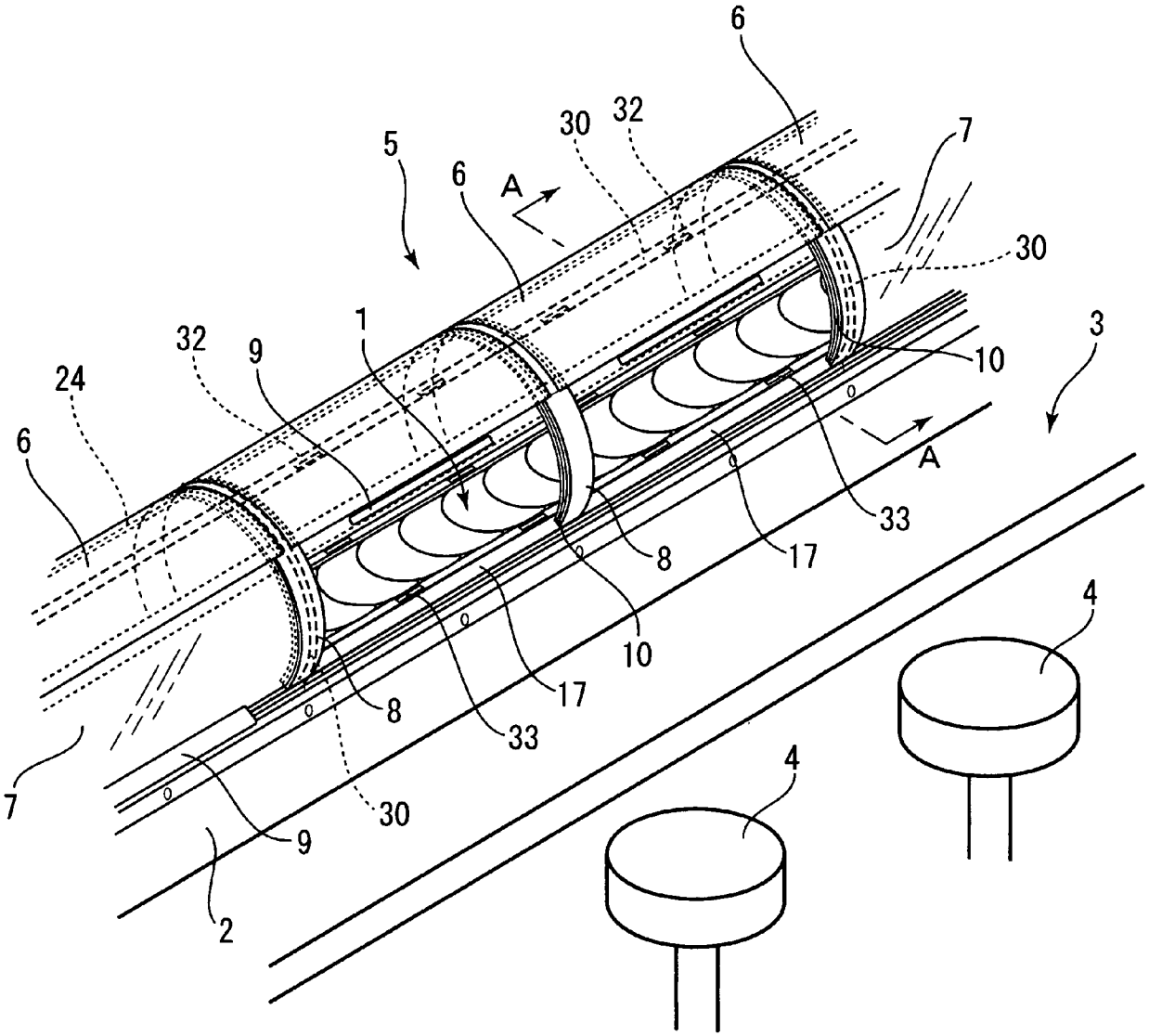
FIG. 1 is a perspective view illustrating one portion of a circulation conveyor for foods and drinks as the embodiment of the present invention.
Figure 2:
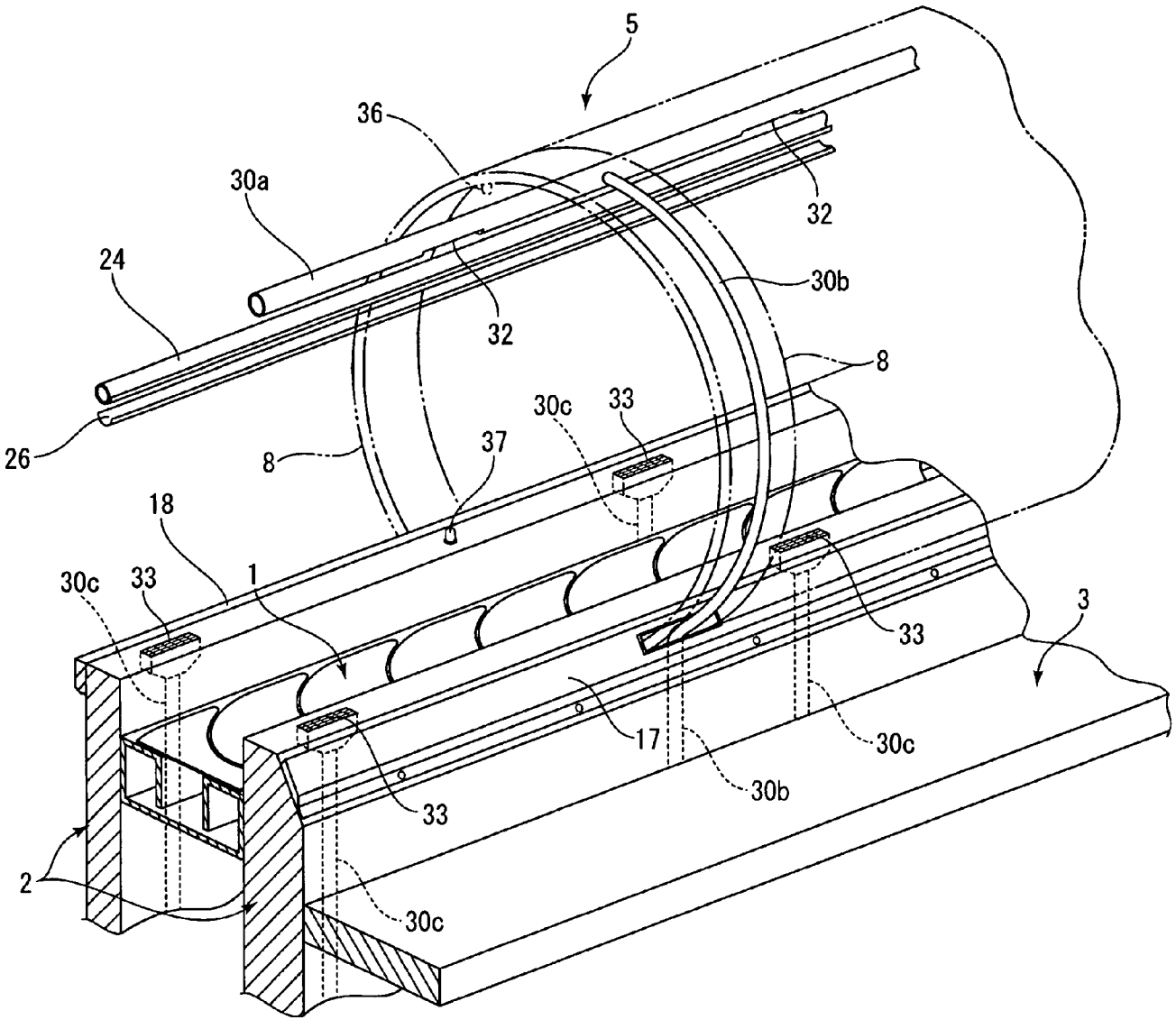
FIG. 2 is a perspective view illustrating an internal configuration of a tunnel section 5 in FIG. 1.
Figure 3:
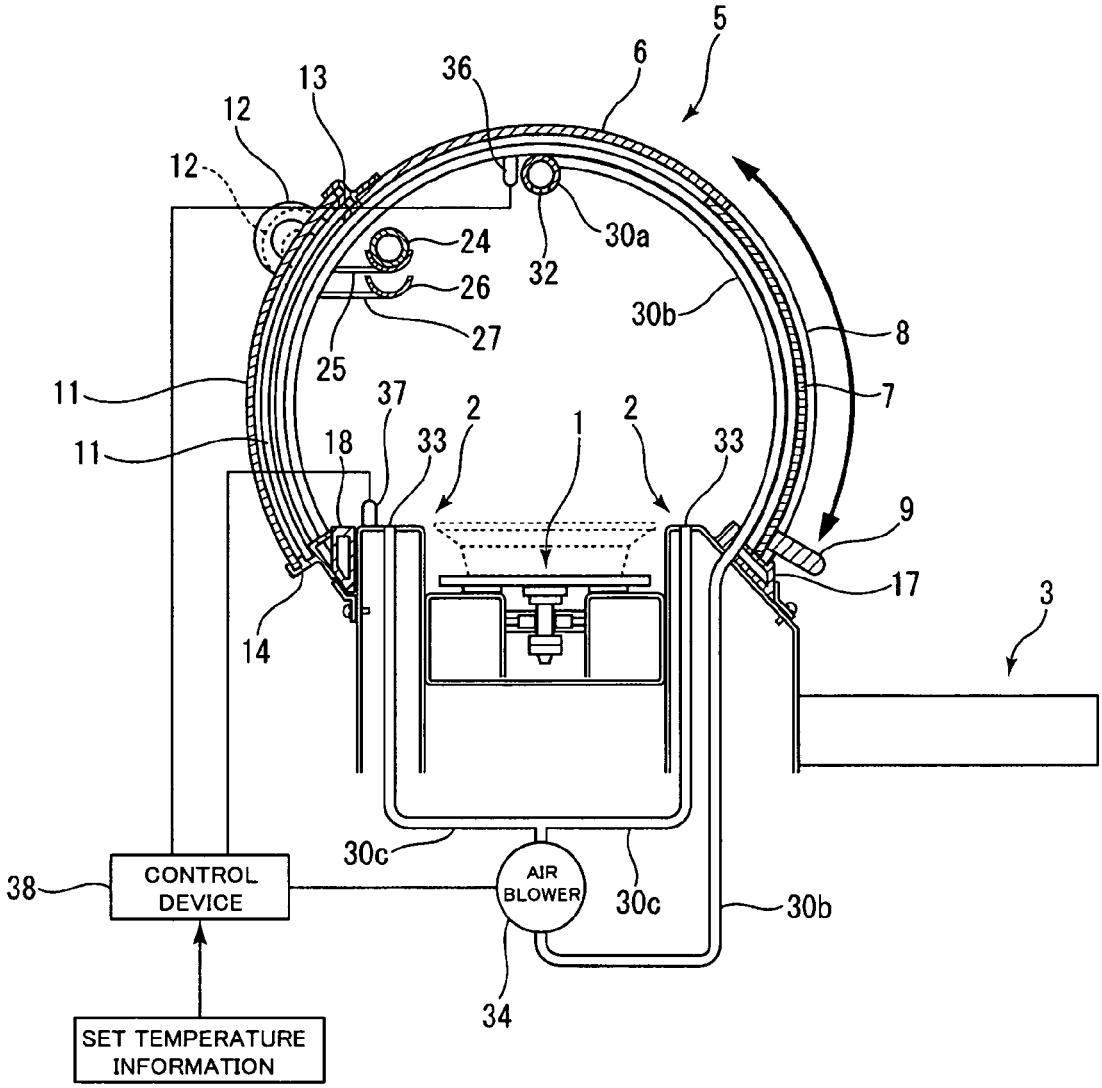
FIG. 3 is a cross-section view of the circulation conveyor for foods and drinks taken along the line A-A in FIG. 1.
Figure 4:
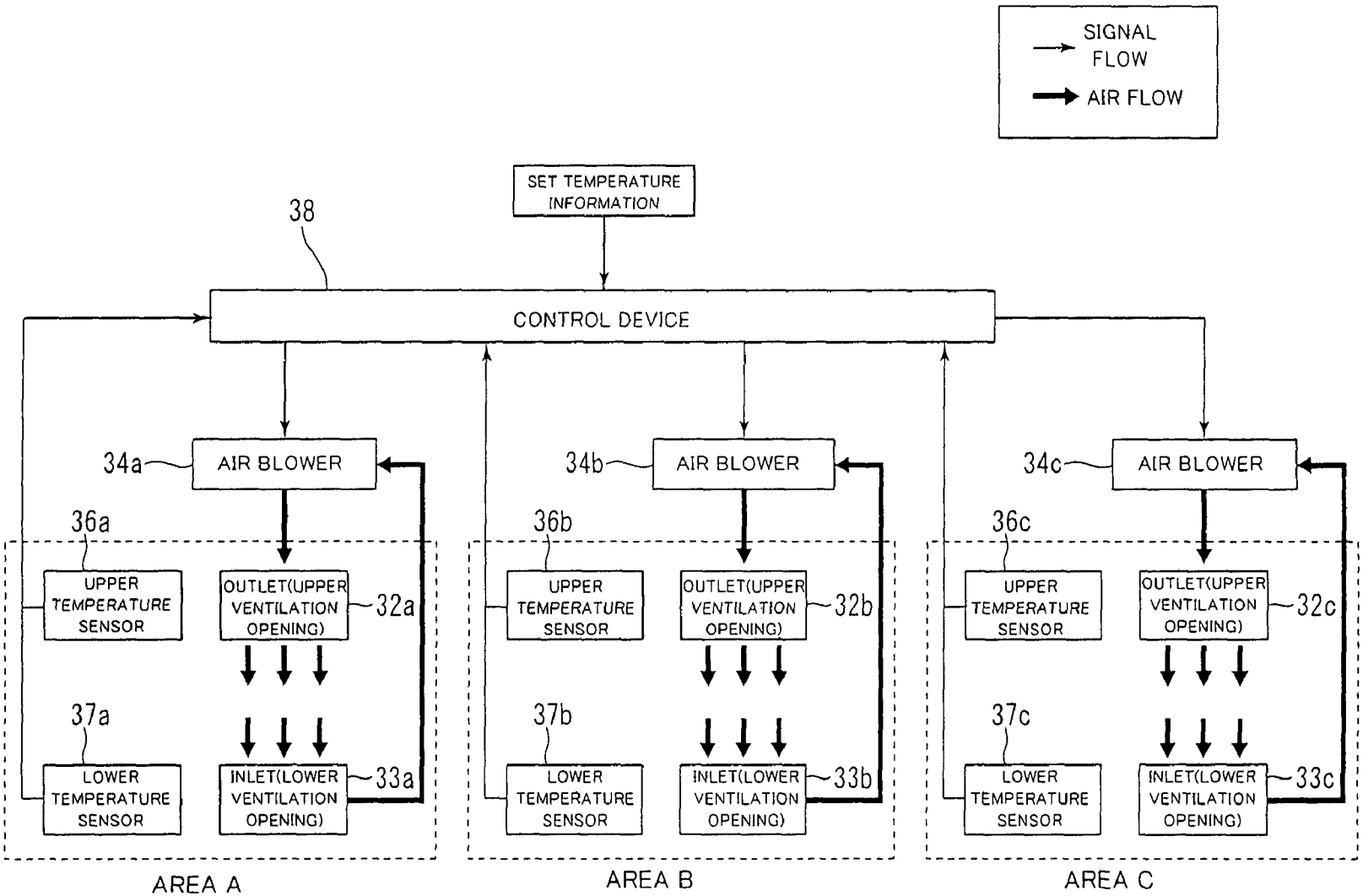
FIG. 4 is a block diagram illustrating a configuration of a control mechanism for controlling air blow of air blowers 34.
Figure 5:
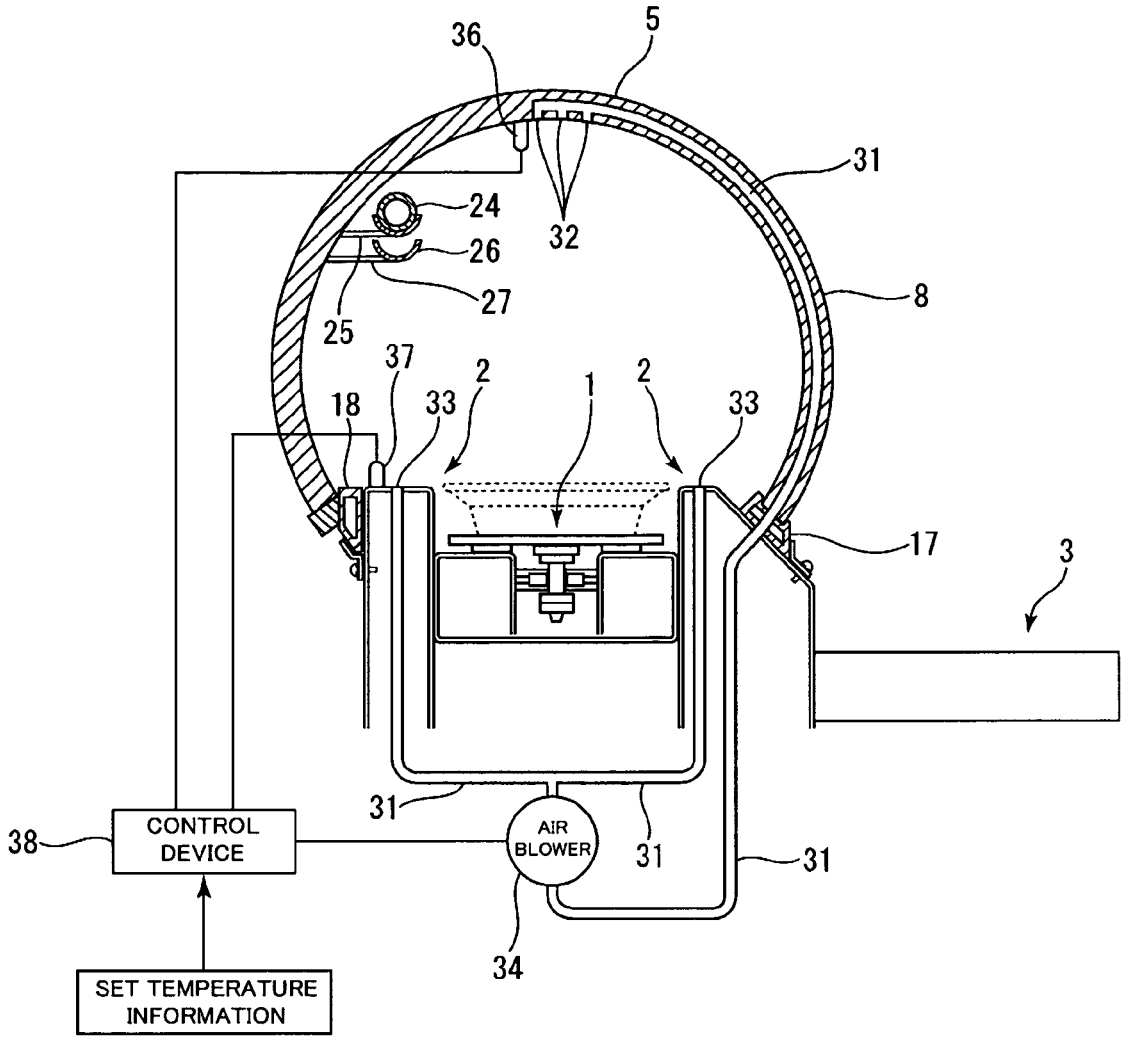
FIG. 5 is a view illustrating a modified example of a communication path of the present invention.

To describe the embodiments of the present invention based on the drawings, FIG. 1 is a perspective view illustrating one portion of a circulation conveyor for foods and drinks as one embodiment of the present invention. FIG. 2 is a perspective view illustrating an internal configuration of a tunnel section 5 in FIG. 1. FIG. 3 is a cross section view along the line A-A in FIG. 1. FIG. 4 is a block diagram illustrating a configuration of a control mechanism for controlling air blow of air blowers 34. FIG. 5 is a view illustrating a modified example of a communication path of the present invention.

FIG. 1 shows one portion of the circulation conveyor for foods and drinks as the embodiment of the present invention. The circulation conveyor for foods and drinks in the embodiment of this invention includes an endless crescent chain conveyor 1 (referred to as a chain conveyor 1 below), which is circulatably disposed in the longitudinal direction of an endlessly formed carrying path, and an unshown driving unit for driving the chain conveyor 1, and the chain conveyor 1 is driven to circulately convey foods and drinks mounted thereon.

There are provided a counter 3 for serving foods and drinks and stools 4 in the longitudinal direction of the carry path in a customer side. There is provided a kitchen, which is not shown, in the other side. Sushi or the like prepared in the kitchen is circulated on the carrying path to be provided to customers.

An upper portion of the chain conveyor 1 is covered by the tunnel section 5 in its longitudinal direction, which is composed of covering members 6, 7 and 11 as described below, and foreign bodies or the like are prevented from attaching to foods and drinks being circulated on the carrying path.

As shown in FIGS. 2 and 3, conveyor housings 2 having a predetermined height are provided at both sides of the chain conveyor 1 in its longitudinal direction, and the rims of plates with foods and drinks placed thereon come in contact with internal surfaces of the conveyor housings 2, and the plates are thereby guided toward the conveyance direction. Base rails 17 and 18 are fixedly disposed in external upper portions of the conveyor housings 2 in its longitudinal direction, and arch-like frame members 8 are disposed at predetermined intervals in the base rails 17 and 18 in its longitudinal direction. Transparent covering members 6, 7 and 11 are attached to the frame members 8, to form the tunnel section 5 inside the covering members.

The covering members 6, 7 and 11 attached to the frame members 8 are divided into panels of an open/close cover 7 constituting a side face in the customer side, a ceiling panel 6 constituting an upper face, and an open/close cover 11 constituting a side face of the kitchen side.

As shown in FIG. 1, both sides of the open/close cover 7 are slidably fitted into concave grooves 10 formed in the side faces of the frame members 8 and 8 which are closest to each other. By grabbing and moving up and down a handle 9 which is protrudingly formed in an external lower portion of the open/close cover 7, the open/close cover 7 can be opened and closed. In addition, the open/close cover 7 is disposed corresponding to each of the stools 4 so that each customer can individually open and close the open/close cover 7.

As shown in FIG. 3, upper and lower end portions of the open/close covers 11 and 11, which are formed facing the kitchen side, are slidably fitted between a traverse slide rail 13 and a traverse slide rail 14 in the longitudinal direction, which are respectively attached to an upper portion and a lower portion between the frame members 8 and 8 which are closest to each other.

Two open/close covers 11 and 11 are disposed between the respective frame members 8 and 8, which are closest to each other, and handles 12 and 12 protrudingly formed in external upper portions of the open/close covers 11 and 11 are moved from side to side so as to open and close the open/close covers 11 and 11.

The open/close covers 7 and 11, and the ceiling panel 6 are removably attached to the frame members 8 by fitting the end portions thereof into the concave grooves 10 or the traverse slide rails 13 and 14, which are formed in the frame members 8 and 8 closest to each other. Therefore, the open/close covers 7 and 11, and the ceiling panel 6 can be removed and cleaned up at an appropriate time, or can be easily replaced when damaged. In addition, since a transparent acryl resin is used to form the open/close covers 7 and 11 and the ceiling panel 6 having a predetermined curvature, customers and chefs can see foods and drinks such as Sushi being circulated on the carrying path of the chain conveyor 1 in the tunnel section 5.

As shown in FIGS. 2 and 3, a cooling and heating pipe 24 for controlling the internal temperature of the tunnel section 5 is provided in the tunnel section 5 in its longitudinal direction. The cooling and heating pipe 24 is maintained by a plurality of maintaining members 25 fixed to predetermined positions of internal surfaces of the frame members 8, and is thereby disposed in a position relatively higher than the middle position of the tunnel section 5 in the vertical direction. The cooling and heating pipe 24 has a heating medium or a cooling medium being circulated inside, and a surface temperature of the cooling and heating pipe 24 is changed to control the internal temperature of the tunnel section 5.

A gutter member 26 maintained by maintaining members 27 fixed to predetermined positions in the tunnel section 5 is disposed in the longitudinal direction below the cooling and heating pipe 24. Therefore, when dew condensation occurs on a surface of the cooling and heating pipe 24 due to a temperature change by the cooling and heating pipe 24, it is possible to prevent water droplets attached to the surface from dropping to foods and drinks, which can be thereby hygienically provided.

In addition, in the tunnel section 5, a plurality of upper ventilation openings 32 disposed above the cooling and heating pipe 24, and a plurality of lower ventilation openings 33 disposed below the cooling and heating pipe 24 are provided at predetermined intervals in the longitudinal direction of the carrying path. The upper ventilation openings 32 and the lower ventilation openings 33 are communicated with each other by communication pipes 30*a* to 30*c* by which air can be circulated. The air blower 34 as an air blowing section for circulating air by drawing air in the tunnel section 5 from the lower ventilation opening 33 into the communication pipes 30*a* to 30*c* and discharging the drawn air from the upper ventilation opening 32 is provided in a predetermined position of the communication pipes 30*a* to 30*c*.

In particular, the communication pipes 30*a* to 30*c* are composed of a communication pipe 30*a*, which is disposed in the longitudinal direction of the carrying path in a top portion in the tunnel section 5, i.e., above the cooling and heating pipe 24 in the tunnel section 5, a plurality of communication pipes 30*b*, which are formed continuously from predetermined positions of the communication pipe 30*a* and extend in the vertical direction along internal surfaces of the frame members 8 in the customer side, and the lower ends of which extend into interior portions of the conveyor housing 2, and communication pipes 30*c* extending from the respective lower ventilation openings 33. The air blower 34 is provided between the communication pipes 30*b* and 30*c*. One portion of the communication pipe 30*b* is disposed in the vertical direction along the internal surface of the frame member 8 in the customer side, and the communication pipe 30*c* and the air blower 34 are disposed inside the conveyor housing 2, in other words, inside the counter on which the carrying path is formed. Therefore, customers cannot see the communication pipes and the appearance is improved.

The plurality of upper ventilation openings 32 are disposed at predetermined intervals in the bottom surface of the communication pipe 30*a* in its longitudinal direction, and the plurality of lower ventilation opening 33 are disposed at predetermined intervals in the top surfaces of the conveyor housings 2 in the longitudinal direction.

As described above, in the tunnel section 5, the plurality of upper ventilation openings 32 and lower ventilation openings 33, which are communicated by the communication pipes 30*a* to 30*c*, are disposed in the longitudinal direction of the carrying path, and by driving the air blower 34, the air in the tunnel section 5 is drawn from the respective lower ventilation openings 33, and the drawn air flows in the communication paths in the communication pipes 30*c*, 30*b* and 30*a*, and is discharged into the tunnel section 5 from the respective upper ventilation openings 32. The air thereby flows from the upper ventilation openings 32 toward the lower ventilation openings 33 in the tunnel section 5, and the air in the tunnel section 5 is circulated through the communication pipes 30.

Therefore, cold air or hot air from the cooling and heating pipe 24 effectively spreads across the tunnel section 5 without being accumulated in the upper portion or the lower portion of the tunnel section 5, and the temperature difference between the regions above and below the cooling and heating pipe 24 becomes less generated in the tunnel section 5. Accordingly, the internal temperature of the tunnel section 5 can be effectively controlled.

In addition, since the lower ventilation openings 33 are provided in the upper surfaces of the conveyor housings 2 which are disposed at right and left sides of the chain conveyor 1, air flows in the vicinity of foods and drinks being circulated on the carrying path, and cold air or hot air from the cooling and heating pipe 24 spreads in the vicinity of the foods and drinks. Therefore, it is possible to effectively bring a surrounding temperature of the foods and drinks close to the surface temperature of the cooling and heating pipe 24. Also, the air supplied from or drawn into the lower ventilation openings 33 does not directly touch the foods and drinks, and therefore, it is possible to prevent the foods and drinks from drying out.

Furthermore, since the lower ventilation openings 33 are formed in the upper surfaces of the conveyor housings 2 for guiding plates, which move on the carrying path, toward the conveyance direction, the lower ventilation openings 33 can be easily formed by using the conveyor housings 2.

In addition, upper temperature sensors 36 are disposed at predetermined upper ventilation openings 32 of the plurality of upper ventilation openings 32, and lower temperature sensors 37 are disposed at the vicinity of predetermined lower ventilation openings 33 of the plurality of lower ventilation openings 33 so as to separately detect temperatures of the regions above and below the cooling and heating pipe 24 in the tunnel section 5. The air blow of the air blower 34 is controlled based on the temperature information detected by the upper temperature sensor 36 and the lower temperature sensor 37.

FIG. 4 is a block diagram illustrating the configuration of the control mechanism for controlling the air blow of the air blower 34 of the circulation conveyor for foods and drinks in the present embodiment.

In the present embodiment, the air blower 34 is provided in each of a plurality of areas (areas A, B and C in the present embodiment) divided in the longitudinal direction of the carrying path such that the air blow is separately controlled in the respective areas A, B and C to circulate air.

In particular, the air blowers 34*a*, 34*b* and 34*c*, the upper temperature sensors 36*a*, 36*b* and 36*c*, and the lower temperature sensors 37*a*, 37*b* and 37*c*, which are respectively provided in the areas A, B and C, are connected via signal lines to a control device 38 as the air blow controlling section, in which a control section (not shown) including a micro computer, a memory section or the like is provided.

The temperature information detected by the upper temperature sensors 36*a*, 36*b* and 36*c*, and the lower temperature sensors 37*a*, 37*b* and 37*c* provided in the respective areas A, B and C is respectively input into the control section of the control device 38. The control section constantly monitors whether or not the temperature difference between the upper and lower temperatures respectively detected by, for example, the upper temperature sensor 36*a* and the lower temperature sensor 37*a* in the area A becomes a first set value (for example 3° C.) or more which is preliminarily set, and when the temperature difference is determined to be 3° C. or more which is the first set value, the control section starts circulation of air by driving the relevant air blower 34*a* of the area A. In addition, after driving the air blower 34*a*, the control section monitors whether or not the temperature difference becomes a second set value (for example 0° C., that is, no temperature difference), and when the temperature difference is determined to be 0° C. which is the second set value, the control section stops the circulation of air by stopping the driving of the air blower 34*a*.

As described above, the control section of the control device 38 can separately control the air blow of the respective air blowers 34*a*, 34*b* and 34*c* provided in the respective areas A, B and C based on the temperature information detected by the respective upper temperature sensors 36*a*, 36*b* and 36*c*, and the respective lower temperature sensors 37*a*, 37*b* and 37*c*, which are independently provided in the corresponding areas.

Therefore, when, for example, a temperature difference is generated between the upper and lower portions of the tunnel section 5 in only one portion of the areas in the longitudinal direction of the carrying path, it is possible to control the air blow of only the corresponding air blower 34 to the portion of the areas in which the temperature difference is generated, without circulating air of the entire areas of the tunnel section 5 in its longitudinal direction, to thereby effectively control the internal temperature of the tunnel section 5 partly. Therefore, the costs for the air blow control of the air blowers 34 can be effectively lowered.

In addition, in the present embodiment, the first set value and the second set value (set temperature information) are preliminarily stored in the unshown memory section provided in the control section of the control device 38. These stored values may be changed arbitrarily by an unshown operation section for changing settings. Also, in addition to the first and second set values, an optimum temperature in the tunnel section 5 or the like may be stored (set) as the set temperature information, and the air blow control may be started when, for example, a temperature difference between an average temperature of the temperatures detected by the upper temperature sensor 36 and the lower temperature sensor 37, and the preliminarily-set optimum temperature becomes a predetermined set value or more.

Also, the control section of the control device 38 in the present embodiment is configured to control the air blow of only the air blower 34, but the control device 38 may be configured to perform temperature control of the cooling and heating pipe 24, to effectively control the temperature in the tunnel section 5 by the combination of the temperature control of the cooling and heating pipe 24 and the air blow control of the air blower 34.

Although the embodiment of the present invention is described based on the drawings as described above, specific configuration is not limited to the embodiment, and modification or addition may be made in the present invention within the range not departing from the scope of the invention.

For instance, one portion of the communication path is composed of the communication pipe 30*b* provided along the internal surface of the frame member 8 in the above embodiment, but a communication path 31 extending in the vertical direction inside the frame member 8 may be formed, and the upper ventilation openings 32 may be formed in the upper internal surface of the frame member 8. In such configuration, the communication path 31 can be formed in a position where the communication path 31 is not seen by customers without using the communication pipes 30*a* to 30*b*. Therefore, the interior appearance of the tunnel section 5 is not spoiled and the entire appearance is improved.

Although one control device 38 controls the air blow of the air blowers 34*a* to 34*c* respectively independently disposed in the areas A, B and C in the above embodiment, the control section may be independently provided in each of the above areas.

In the above embodiment, as the air blow control, the control section of the control device 38 drives the air blower 34 when the temperature difference between the upper temperature and the lower temperature becomes 3° C. or more, and stops driving the air blower 34 when the temperature difference becomes 0° C. However, the air blower 34 may be driven in normal times and the air volume thereof may be controlled corresponding to the level of the temperature difference. In other words, the air blow control by the air blow controlling section in the present invention is not limited to the control of driving and stopping driving the air blower 34 as the air blowing section based on the upper and lower temperatures of the tunnel section 5, but it also includes the control of changing the air volume.

In the above embodiment, the air from the air blower 34 is blown into the tunnel section 5 from the upper ventilation opening 32, and the air in the tunnel section 5 is drawn from the lower ventilation opening 33 toward the air blower 34. However, the air blow direction in the tunnel section 5 is not limited to the direction from the upper region toward the lower region, and the air blower 34 may be driven reversely to blow air from the lower region toward the upper region. As described above, by switching the air blow direction by the air blower 34 depending on whether the optimum temperature in the tunnel section 5 is high temperature or low temperature, it is possible to more effectively reducing the costs for the air blow control in the tunnel section 5.

In addition, although the air blower 34 is disposed between the communication pipes 30*c* and 30*b* which constitute the communication path, the air blower 34 may be disposed at, for example, the lower ventilation opening 33 or the upper ventilation opening 32.

In addition, in the above embodiment, the cooling and heating pipe 24 is disposed in a position relatively higher than the middle position of the tunnel section 5 in the vertical direction, from a hygiene and safety matter in order for the cooling and heating pipe 24 not to touch customers or foods and drinks being circulated on the carrying path. However, the cooling and heating pipe 24 may be disposed in the middle position or in a position lower than the middle position in the vertical direction.

What is claimed is:

1. A circulation conveyor for foods and drinks comprising:

a tunnel section covering an upper portion of and in a longitudinal direction of a circulation-type carrying path for conveying and supplying foods and drinks;

a cooling and heating pipe disposed inside the tunnel section in its longitudinal direction, wherein a surface temperature of said cooling and heating pipe changes to control an internal temperature of the tunnel section, and wherein, in the tunnel section, an upper ventilation opening disposed above the cooling and heating pipe and a lower ventilation opening disposed below the cooling and heating pipe are provided in the longitudinal direction of the carrying path, the upper ventilation opening and the lower ventilation opening communicate with each other via a communication path, and an air blowing section is provided for circulating air in the tunnel section by drawing air from a first one of the upper ventilation opening and the lower ventilation opening, into the communication path, and discharging the drawn air through a second one of the upper ventilation opening and the lower ventilation opening;

an upper temperature sensor for detecting a temperature of an upper region above the cooling and heating pipe in the tunnel section;

a lower temperature sensor for detecting a temperature of a lower region below the cooling and heating pipe in the tunnel section; and an air blow controlling section for controlling air blow of the air blowing section based on temperatures respectively detected by the upper temperature sensor and the lower temperature sensor.

2. The circulation conveyor for foods and drinks according to claim 1, wherein the lower ventilation opening is disposed at both sides of the carrying path.

3. The circulation conveyor for foods and drinks according to claim 2, wherein a guiding wall for guiding foods and drinks that move on the carrying path toward a conveyance direction, is disposed at a side of the carrying path, and the lower ventilation opening is formed in a surface of the guiding wall.

4. The circulation conveyor for foods and drinks according to claim 2, wherein the tunnel section comprises a plurality of frame members disposed at predetermined positions of the carrying path and covering members attached to the frame members, and one portion of the communication path is formed inside the frame member.

5. The circulation conveyor for foods and drinks according to claim 2, wherein the tunnel section is configured such that the air blowing section comprises a plurality of air blowers independently disposed in each of a plurality of areas divided in the longitudinal direction of the carrying path so as to independently circulate air, and the air blow controlling section controls air blow of the air blowing section independently in each of the plurality of areas, based on temperatures respectively detected by a plurality of upper temperature sensors and of lower temperature sensors, said upper temperature sensors and lower temperature sensors being independently disposed in each of the plurality of areas.

6. The circulation conveyor for foods and drinks according to claim 1, wherein a guiding wall for guiding foods and drinks that move on the carrying path toward a conveyance direction, is disposed at a side of the carrying path, and the lower ventilation opening is formed in a surface of the guiding wall.

7. The circulation conveyor for foods and drinks according to claim 6, wherein the tunnel section comprises a plurality of frame members disposed at predetermined positions of the carrying path and covering members attached to the frame members, and one portion of the communication path is formed inside the frame member.

8. The circulation conveyor for foods and drinks according to claim 6, wherein the tunnel section is configured such that the air blowing section comprises a plurality of air blowers independently disposed in each of a plurality of areas divided in the longitudinal direction of the carrying path so as to independently circulate air, and the air blow controlling section controls air blow of the air blowing section independently in each of the plurality of areas, based on temperatures respectively detected by a plurality of upper temperature sensors and of lower temperature sensors, said upper temperature sensors and lower temperature sensors being independently disposed in each of the plurality of areas.

9. The circulation conveyor for foods and drinks according to claim 1, wherein the tunnel section comprises a plurality of frame members disposed at predetermined positions of the carrying path and covering members attached to the frame members, and one portion of the communication path is formed inside the frame member.

10. The circulation conveyor for foods and drinks according to claim 9, wherein the tunnel section is configured such that the air blowing section comprises a plurality of air blowers independently disposed in each of a plurality of areas divided in the longitudinal direction of the carrying path so as to independently circulate air, and the air blow controlling section controls air blow of the air blowing section independently in each of the plurality of areas, based on temperatures respectively detected by a plurality of upper temperature sensors and of lower temperature sensors, said upper temperature sensors and lower temperature sensors being independently disposed in each of the plurality of areas.

11. The circulation conveyor for foods and drinks according to claim 1, wherein the tunnel section is configured such that the air blowing section comprises a plurality of air blowers independently disposed in each of a plurality of areas divided in the longitudinal direction of the carrying path so as to independently circulate air, and the air blow controlling section controls air blow of the air blowing section independently in each of the plurality of areas, based on temperatures respectively detected by a plurality of upper temperature sensors and of lower temperature sensors, said upper temperature sensors and lower temperature sensors being independently disposed in each of the plurality of areas.

* * * * *